United States Patent [19]

Bannister et al.

[11] Patent Number: 4,796,443

[45] Date of Patent: Jan. 10, 1989

[54] COMFORT EARRING CLIP

[75] Inventors: A. Karen Bannister, West Warwick, R.I.; Kristen Brandriff, Brooklyn, Conn.; John A. Carlotto, Barrington; Richard J. DiDonato, North Providence, both of R.I.; Virginia Haigh, Bronxville, N.Y.; Edmond Sirois, Providence, R.I.

[73] Assignee: Trifari, Krussman & Fishel, Inc., East Providence, R.I.

[21] Appl. No.: 9,964

[22] Filed: Feb. 2, 1987

[51] Int. Cl.[4] ..... A44C 7/00

[52] U.S. Cl. ..... 63/14.5; 63/14.6

[58] Field of Search ..... 63/14 R, 14 A, 14 B, 63/14 C, 14 D, 14 E, 14 F, 14 G

[56] References Cited

U.S. PATENT DOCUMENTS

| | | | |
|---|---|---|---|
| D. 242,817 | 12/1976 | Saccoccio | D11/88 |
| 1,507,154 | 9/1924 | Bonniol | 63/14 F |
| 2,769,322 | 11/1956 | Czuch | 63/12 |
| 2,882,702 | 4/1959 | Goldberg | 63/14 B |
| 2,961,854 | 11/1960 | Kettell | 63/14 E |
| 3,176,475 | 4/1965 | Saccoccio . | |
| 3,462,808 | 8/1969 | Saccoccio | 24/248 |
| 3,568,271 | 3/1971 | Saccoccio | 24/248 |
| 3,987,644 | 10/1976 | Saccoccio . | |
| 3,990,266 | 11/1976 | Saccoccio | 24/252 B |
| 4,185,471 | 1/1980 | Saccoccio | 24/248 R |
| 4,188,799 | 2/1980 | Saccoccio | 24/252 B |

*Primary Examiner*—Richard J. Johnson

*Attorney, Agent, or Firm*—Neuman, Williams, Anderson & Olson

[57] ABSTRACT

A support device for an earring which includes a back support. A back ear clamping member carried by the back support is adjustable to a forward and rearward position with respect to a front ear clamping member. The back ear clamping member is free to move limitedly in both a horizontal and vertical direction when either in forward or rearward adjusted position, but when in an intermediate position is substantially restrained from movement.

5 Claims, 1 Drawing Sheet

COMFORT EARRING CLIP

BACKGROUND OF THE INVENTION

Earrings which are widely worn as ornamentation are generally of two types. For people who have pierced ears, earrings having attachment means which extend through the ear lobe can be worn. The other general type of earring is the clip-on type, which can be used by people who have or do not have pierced ears. With the clip-on type earring, the ear lobe is clamped between two opposed clamping members and maintained on the ear by friction. The opposed clamping parts in some designs are clamped against the ear lobe by spring action and in other cases a screw type arrangement is provided so that the clamping parts can be adjusted by screw action to remain apart a set distance. Clip-on type earrings often cause discomfort to the wearer, for example, continuously applied pressure on one part of the ear lobe, even though slight, may produce discomfort, irritation, and sometimes a nervous reaction in the wearer.

It is a principal object of the invention to provide a novel ear decoration in the form of a clip which may be supported on the structure of an ear without causing pain or deformation of the flesh of the ear.

It is a further object of the invention to provide a clip for an earring decoration which is floatably adjustable to conform to different ear lobe shapes and thicknesses.

SUMMARY OF THE INVENTION

The invention relates to a clip device or support for a decorative earring. The clip device includes a back support body having pivotally attached thereto a front ear clamping member. A back ear clamping member is carried by the back support body and is adjustable to a forward position and a rearward position with respect to said front ear clamping member. The back ear clamping member is free to move limitedly in both a horizontal and vertical direction when either in the forward or rearward adjusted position. The back ear clamping member is adjustable to a set position intermediate the forward or rearward adjusted position also, but in the intermediate position is substantially restrained from movement in either a horizontal or vertical direction.

The present invention, both as to its organization and manner of operation, together with further objects and advantages thereof, may best be understood by reference to the following description of the preferred embodiments, taken in connection with the accompanying drawings, in which:

DESCRIPTION OF PREFERRED EMBODIMENTS

Figure 1:
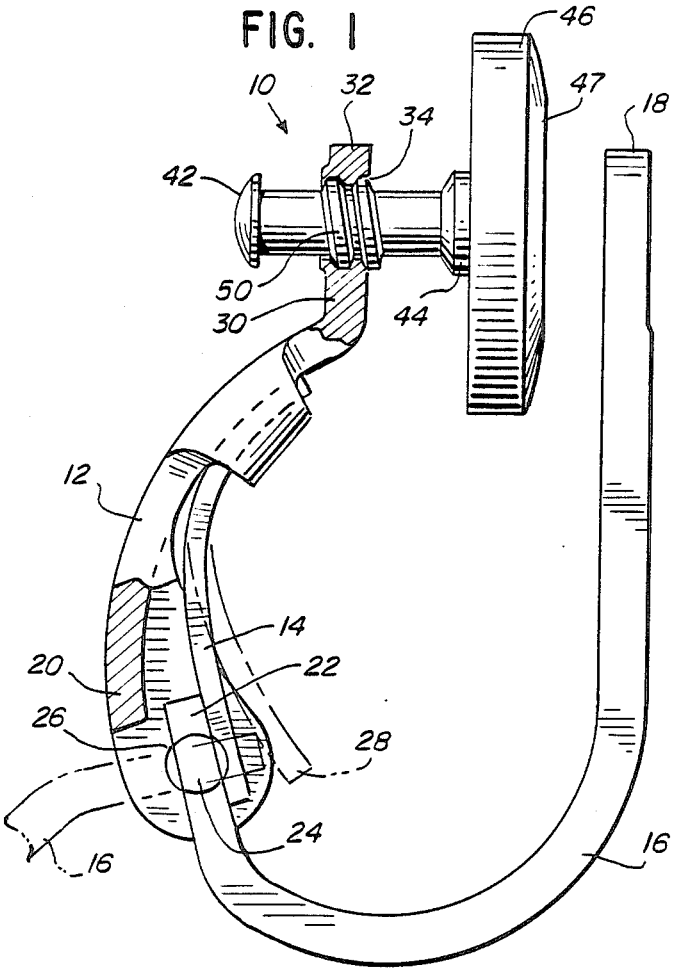
FIG. 1 is a side elevational view with parts broken away of an earring clip device in accordance with one preferred embodiment of the invention.

Referring to FIG. 1, the earring clip 10 shown in the drawings is constituted by an arcuate shaped back member 12 to which spring leaf 14 is secured. The back 12 is sufficiently wide so as to provide support for leaf spring 14 and is provided with flared side edges 20 along the lower portion thereof. Leaf spring 14 is secured near the upper portion on the inner face of the back member 12. Pivotally attached to the lower end of back member 12 is a generally J-shaped front ear clamping member 16 which terminates in an enlarged discoidal end 18. The distal end 22 of clamping member 16 fits within the enlarged side edges 20 of back 12 and has outwardly projecting pivot pins 24 which project through holes 26 in the side edges 20 of back 12 to form a pivot point for clamping member 16. The end 22 of clamping member 16 is sandwiched between back 12 and leaf spring 14.

The lower end portion 28 of leaf spring 14 is not attached, permitting it to be flexed inwardly when the clamping member 16 is forced downwardly and rearwardly to an open position as shown by the dotted lines in FIG. 1. When the clip is worn on an ear lobe, spring leaf 14 normally biases clamping member 16 in the closed position so as to engage an ear lobe and this position is shown by solid lines in FIG. 1. The attachment of clamping member 16 to back member 12 so that the clamping member can be pivotally moved from an open to closed position can take a variety of forms other than the specific arrangement described.

A generally flat neck portion 30 extends upwardly from back member 12 and terminates in an enlarged, generally circular head 32. Head 32 is provided with a threaded opening 34 through which extends adjustable back ear clamping rod 40. Clamping rod 40 has a dumbbell configuration with somewhat enlarged end modules 42 and 44. An enlarged ear pad 46 is attached to end 44. The ear pad 46 is preferably circular in shape with a relatively flat surface 47 of relatively large size so as to engage a substantial portion of the ear lobe of one wearing the earring clip.

Figure 2:
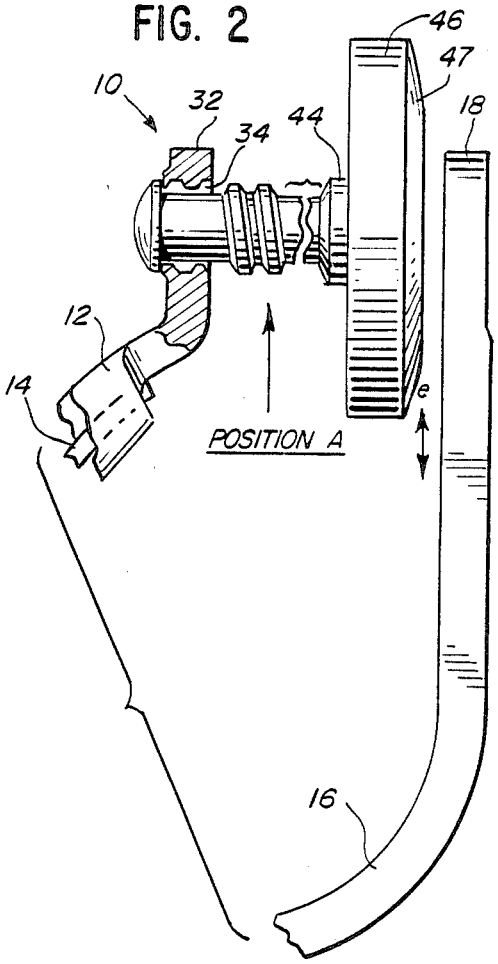
FIG. 2 is a view in part similar to FIG. 1 showing a clamping part in one operative position.
Figure 3:
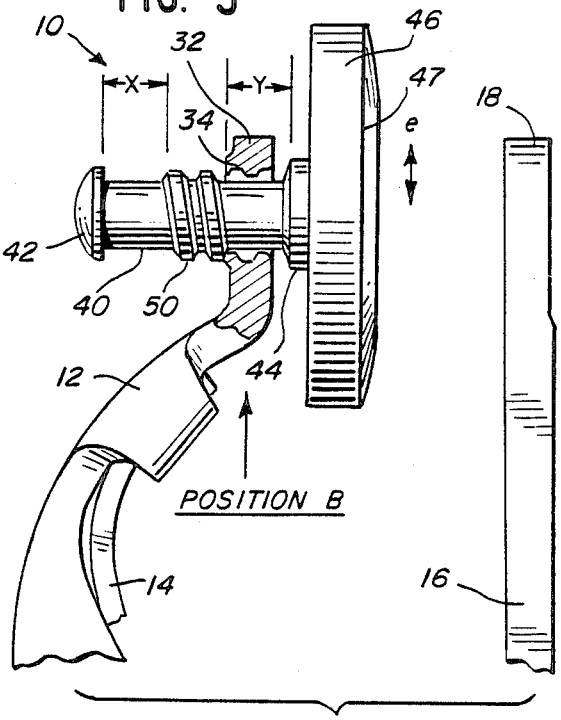
FIG. 3 is a view in part similar to FIG. 1 showing the clamping part in another operative position.

Approximately at its intermediate point, clamping rod 40 is provided with several screw threads 50 whereby clamping rod 40 can be screwed through the complimentary threaded opening 34 in head 32 of the back clip member 12 and moved to either position A as shown in FIG. 2 or position B as shown in FIG. 3. The circumference of the clamping rod 40 is smaller than the threaded opening 34. Accordingly, the clamping rod 40 can, by screw action, be positioned in a forward position as shown in FIG. 2 or in a rearward position as in FIG. 3. In FIG. 2 the clamping rod is positioned so that the ear-engaging pad 46 is nearer to the discoidal end portion 18 of the front ear clamping member 16. In FIG. 3, the clamping rod is positioned so that the ear pad 46 is more distant from the discoidal end portion 18 of the clamping member 16. When the clamping rod 40 is in either the position A shown in FIG. 2 or position B shown in FIG. 3, it is capable of freely moving or floating in a horizontal direction with the free float distance designated X and Y being defined by the external threaded portion 50 and the end portions 42 or 44 thereon. Typically both distance X and Y can be on the order of 0.04 inch with the thickness of head 32 being approximately 0.015 inch. When in either position A or position B, the clamping rod 40, having a smaller circumference than the opening 34, can undergo limited vertical or wiggling movement as indicated by arrow E. This enables the ear clip to be comfortably worn in different positions and also to compensate for different ear lobe shapes and thicknesses.

A variety of decorative items can be included as part of the clip or attached thereto in any suitable manner such as welding or by use of adhesives.

To wear the ear clip, the wearer pivotally shifts front ear clamping member 16 to its open position (shown in dotted lines in FIG. 1) and places the clip so as to straddle the ear lobe and the clamping member 16 is then pivoted to its closed position. The wearer then adjusts the ear clip 10 to a comfortable position by screwing the adjustable clamping rod 40 so as to position it in either position A or B, the choice depending upon the shape and thickness of the portion of the ear lobe on which it is to be worn. When in either position, the clamping rod is free to move in both horizontal and vertical directions so as to comfortably engage and conform to the ear lobe of the wearer. If desired, the clamping rod 40 can be adjusted so that its external threaded portion 50 is engaged within the threaded opening 34 in head 32 of the back member. In this position (FIG. 1), the clamping rod is set and is not free to float in either a horizontal or vertical direction.

Figure 4:
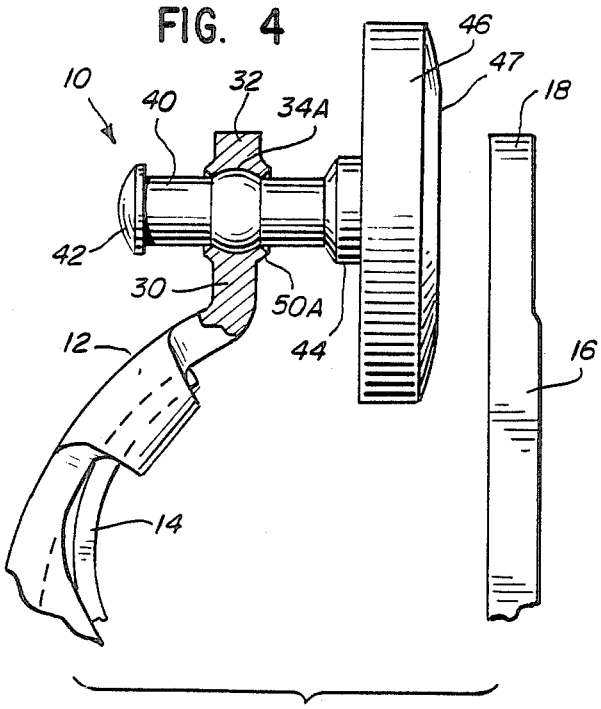
FIG. 4 is a view in part similar to FIG. 1 showing another preferred embodiment of the invention.

In another preferred embodiment of the invention, a ball and socket arrangement is utilized to provide for adjustment of the back ear clamping member. Thus, referring to FIG. 4, the head 32 of the back member 12 is provided with a spheroidal opening 34A and the clamping rod 40 is provided with a complementary spheroidal protuberance 50A. When the protuberance 50A is aligned with the spheroidal opening 34A the clamping rod 40 can be moved to either the forward position (A) or the rearward position (B). A slight rotation of clamping rod 40 so that the spheroidal protuberance 50A is not properly aligned with spheroidal opening 34A results in the clamping rod being confined in either position A or position B. Again, in either position the back ear clamping member can freely move in both a horizontal direction and a vertical direction.

Those modifications and equivalents which fall within the spirit of the invention are to be considered a part thereof.

What is claimed is:

1. A support device for an earring which device comprises a back support element having pivotally attached thereto a front ear clamping member, a back ear clamping member carried by said back support element which is adjustable to a forward position and to a rearward position with respect to said front ear clamping member, said back ear clamping member being floatably free to move horizontally and vertically when either in the forward or rearward position to conform to the shape and thickness or the earlobe of the wearer of the earring support device.

2. A support device according to claim 1 in which the back ear clamping member is adjustable to a forward position and to a rearward position by screw action.

3. A support device for an earring which device comprises a back support element having a head portion provided with an opening therein, a front ear clamping member having at one end thereof an ear clamping pad pivotally attached to said back support element, a back ear clamping member in the form of a rod having approximately intermediate thereof a protuberance which is adapted to be received in and to pass through said opening on said head portion of the back support element whereby said protuberance on said rod can be positioned to either side of said opening in said head portion and when so positioned being free to move horizontally and vertically.

4. A support device according to claim 3 wherein the opening in said head portion is threaded and said protuberance on said rod comprises screw threads.

5. A support device according to claim 3 wherein the opening in said head portion is spheroidal and said protuberance on said rod is spheroidal.

* * * * *